United States Patent [19]

Cousins

[11] 4,340,144

[45] Jul. 20, 1982

[54] ARTICLE SUPPORT ARRANGEMENT

[75] Inventor: Morison S. Cousins, New York, N.Y.

[73] Assignee: Heller Designs, Inc., New York, N.Y.

[21] Appl. No.: 161,243

[22] Filed: Jun. 20, 1980

[51] Int. Cl.[3] ..... A47F 5/08

[52] U.S. Cl. ..... 211/87; 211/106; 248/222.2

[58] Field of Search ..... 211/87, 106, 607; 248/222.2, 222.3, 220.3, 220.2, 226.5

[56] References Cited

U.S. PATENT DOCUMENTS

| | | | |
|---|---|---|---|
| 2,773,473 | 12/1956 | Martin | 248/220.2 X |
| 3,525,494 | 8/1970 | Principe | 248/222.2 X |
| 3,659,722 | 5/1972 | Carroll | 211/106 |
| 3,695,568 | 10/1972 | Hogrebe | 248/222.2 |
| 4,234,094 | 11/1980 | Jorgensen | 211/106 X |

FOREIGN PATENT DOCUMENTS

| | | | |
|---|---|---|---|
| 1478879 | 3/1967 | France | 211/106 |
| 2357338 | 2/1978 | France | 248/220.3 |
| 673737 | 11/1964 | Italy | 211/106 |

*Primary Examiner*—Roy D. Frazier
*Assistant Examiner*—Robert W. Gibson, Jr.
*Attorney, Agent, or Firm*—Alan H. Levine

[57] ABSTRACT

An article support arrangement including a grid, adapted to be mounted on a wall, having a plurality of non-circular openings, and a plurality of article support elements adapted to be mounted on the grid. Each support element has a non-circular base and a projection extending from the base for engaging an article to be supported. The base fits into any selected grid opening in such a way that it cannot be pulled directly out of the plane of the grid; preferably, the base also cannot rotate with respect to the grid opening. The grid is preferably fabricated of metal wire, and the openings are square. Two grooves in the base open in opposite directions and accommodate two opposite edges of a grid opening. A bracket fits through one of the openings to mount the grid on a wall.

12 Claims, 11 Drawing Figures

FIG. 1
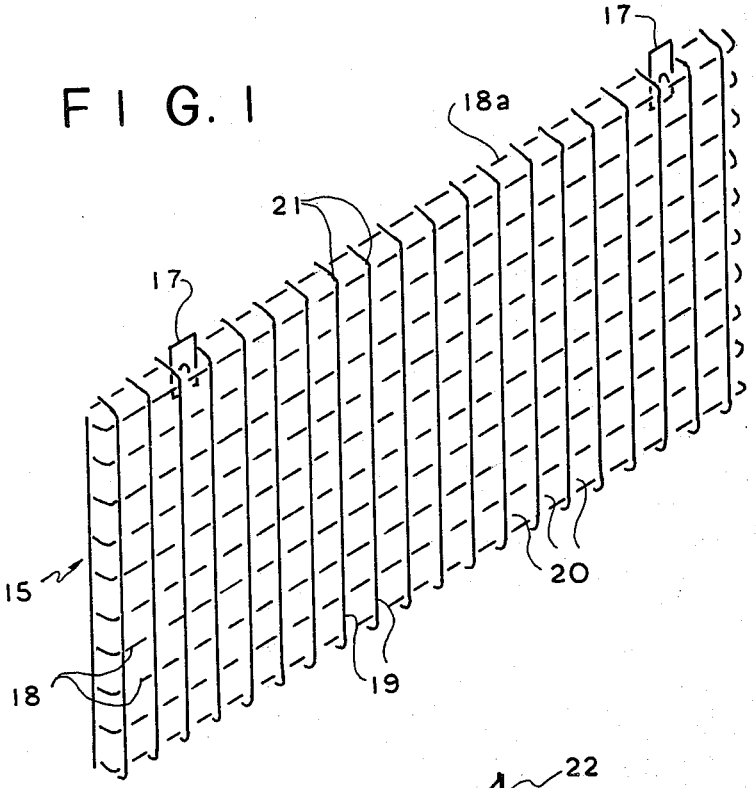
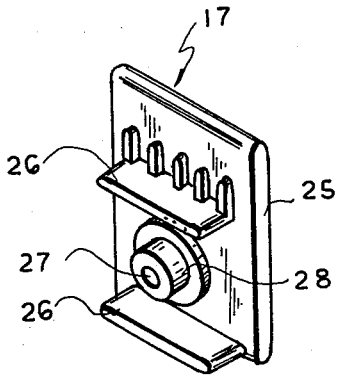
FIG. 10
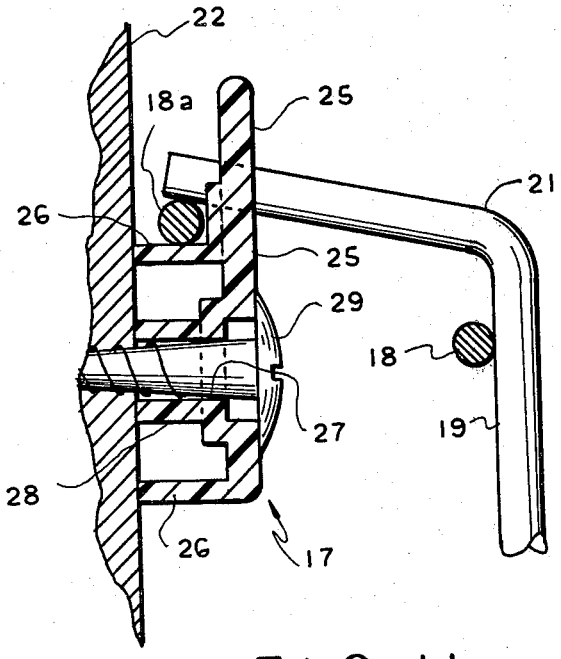
FIG. 11

FIG. 6
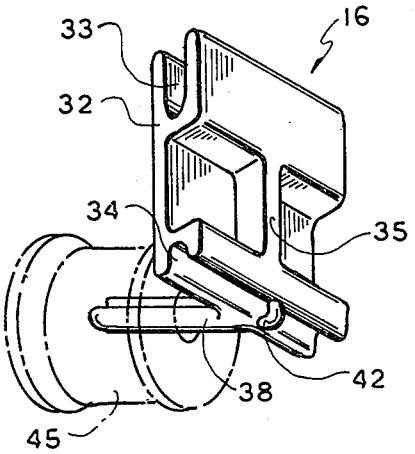
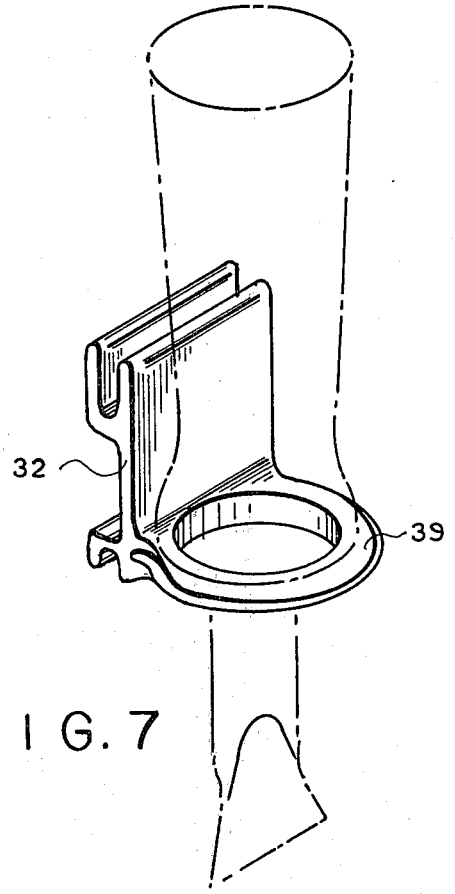
FIG. 7
FIG. 8
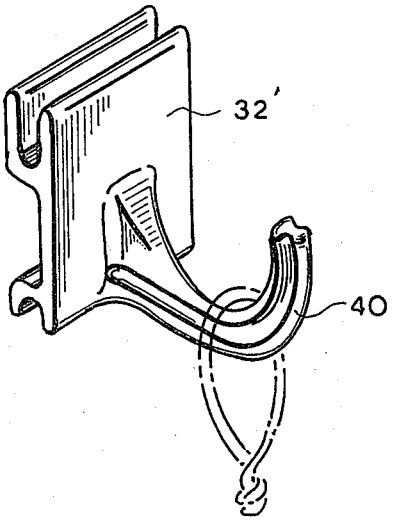
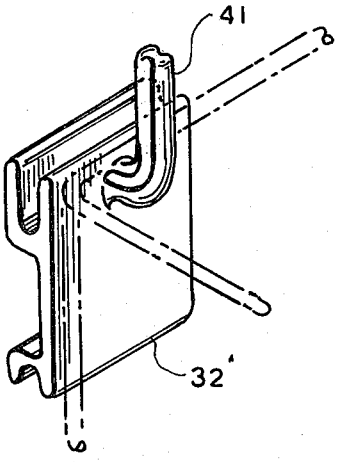
FIG. 9

ARTICLE SUPPORT ARRANGEMENT

This invention relates to article support arrangements of the type involving a board having an array of holes, and article support elements optionally positionable in any selected ones of the holes.

A typical arrangement of this type is one employing the well-known "pegboard", which is a thin rigid board of, for example, plywood or pressed board, furnished with a plurality of small round holes located in a pattern defined by the points of intersection of a grid of horizontal and vertical lines. The pegboard is used with wire hooks of circular cross-sectional shape and having a diameter small enough to fit through a pegboard hole. The rear portion of each hook is shaped so that after passing through a selected hole, it causes the front portion of the hook to project forwardly from the pegboard. Articles such as tools, kitchen utensils, clothing, and a wide variety of other items can be hung from the hooks.

A problem is presented by this conventional pegboard arrangement because the hooks are not held firmly within the pegboard holes. When an article suspended from a hook is lifted off that hook, the upwardly moving article may hit or brush the hook, as a result of which the hook often disengages from the pegboard hole and actually falls off the board. Also, when an unoccupied hook mounted on the board is hit or brushed by a person or article moving past it, the hook is easily dislodged from the board.

Other disadvantages of conventional pegboard are that it is relatively heavy and cumbersome to handle, and that it is not particularly attractive in appearance.

It is a general object of the present invention to overcome the problems and disadvantages inherent in the use of conventional pegboard described above.

It is a more specific object of the invention to provide an article support arrangement of the general type described wherein the article support elements can be optionally positioned in a variety of openings in the board in a very secure manner so that they are not accidently dislodged from the board during normal use of the arrangement.

It is another object of the invention to provide such an arrangement wherein the board is in the form of a grid, e.g., formed of interconnected wires, which is light in weight, and has an airy, esthetically pleasing appearance.

Additional objects and features of the invention will be apparent from the following description, in which reference is made to the accompanying drawings.

In the drawings:

FIG. 1 is a perspective view of a grid forming part of an article support arrangement according to this invention;

FIGS. 6–9 are perspective views showing various illustrative article support elements according to this invention;

FIG. 10 is a perspective view of a bracket used to mount the grid on a wall; and FIG. 11 is a vertical cross-sectional view taken along line 11—11 of FIG. 2.

Figure 2:
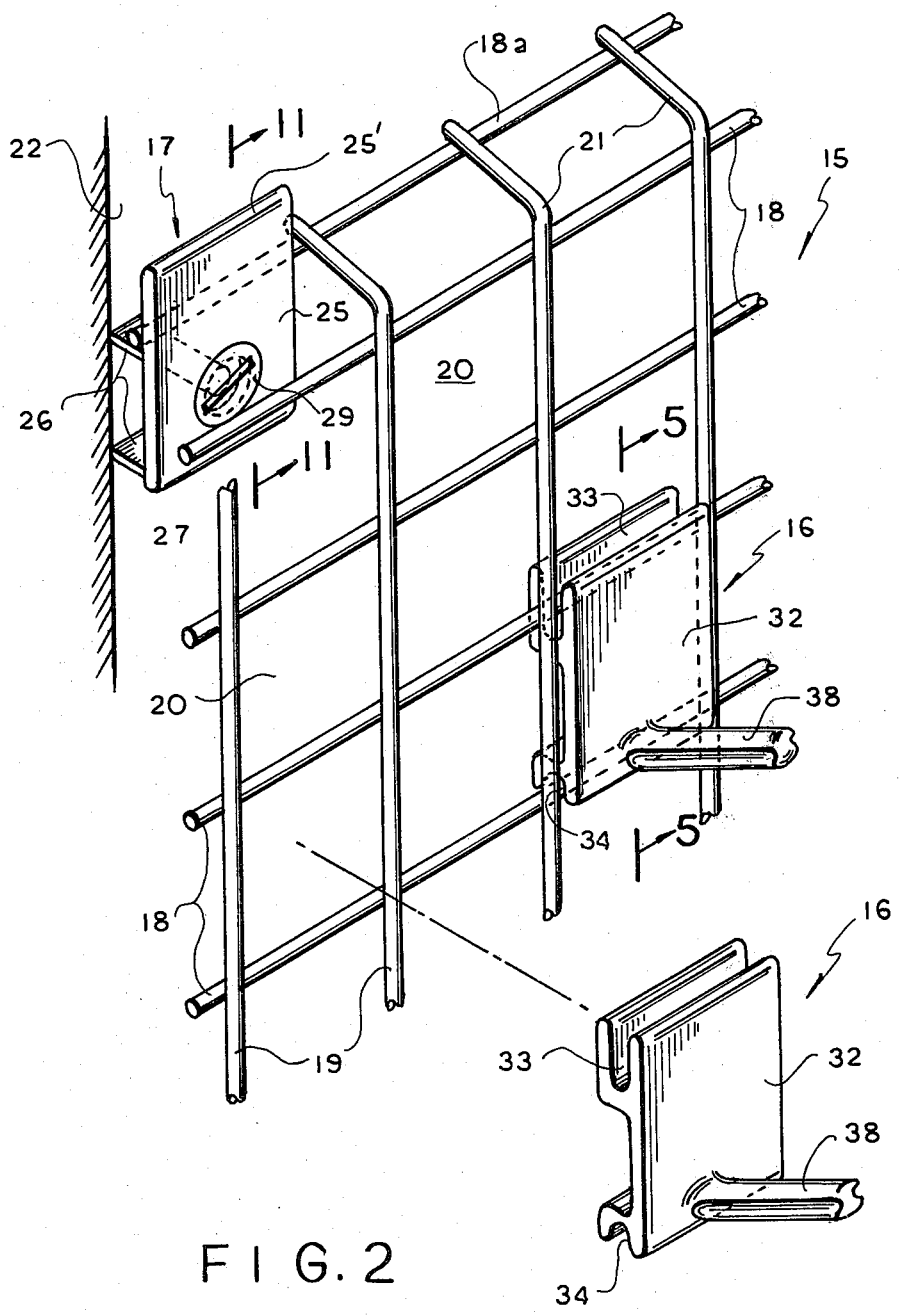
FIG. 2 is an enlarged fragmentary perspective view, partially exploded, showing a part of the grid of FIG. 1 together with illustrative article support elements and a wall mounting bracket, all according to this invention.

The article support arrangement chosen to illustrate the present invention, and shown in FIGS. 1 and 2, comprises generally a grid or mesh structure 15, a plurality of article support elements 16, and mounting brackets 17. Preferably, grid 15 is fabricated of spaced apart horizontal metal wires 18 and spaced apart vertical metal wires 19 arranged in mutually perpendicular intersecting relationship, and joined together, as by welding, at their points of intersection. If all the parallel wires are equidistantly spaced apart, the openings 20 formed between the successive pair of wires are square, as shown. Where the spacing between the vertical wires is different from that between the horizontal wires, the openings will be rectangular. Preferably, after fabrication of grid 15, it is dipped in paint or liquid plastic to give it a finished appearance and an attractive color.

The grid as a whole may have any shape, although a rectangular shape is preferred since it is most efficient from the point of view of utilization of the maximum number of holes 10 for a given area of the grid. At least one margin of grid 15 is bent rearwardly, as indicated at 21 in FIGS. 1, 2, and 11, to produce a rearwardly extending lip carrying at its free edge the outermost horizontal wire 18*a*. The lip serves both to space the major area of grid 15 from a wall 22 (FIGS. 2 and 11) on which the grid is mounted, and as a means for mounting the grid on a wall. Preferably, all four margins of the grid are bent rearwardly to form lips around the entire grid (as shown in FIG. 1), so as to stabilize the grid on the wall and permit mounting the grid in a variety of orientations.

A mounting bracket 17 for mounting grid 15 on a wall 22 is best illustrated in FIGS. 2, 10, and 11. This bracket, which may be of molded plastic, comprises a front plate 25 having two rearwardly projecting ledges 26. A hole 27 in the plate, between the ledges, is surrounded by a rearwardly extending boss 28. The rearward edges of ledges 26 and boss 28 all terminate in the same plane. By means of a screw 29 passing through hole 27, bracket 17 can be fastened to wall 22. Plate 25 is spaced from the wall by ledges 26 and boss 28, and the bracket is oriented so that one end 25' of the plate projects upwardly beyond one of the ledges, as shown in FIGS. 2 and 11. The width of plate end 25' is less than the width of an opening 20 in grid 15. A lip of grid 15 is engaged with bracket 17 by passing plate end 25' through an opening 20 in the lip until wire 18*a* becomes seated behind plate 25. For stability, at least two brackets 17 should be used to mount a grid, as illustrated in FIG. 1.

A preferred form of article support element 16, shown in FIGS. 2–6, may be fabricated of molded plastic. Element 16 has a non-circular base 32, preferably rectangular, as shown. The width of base 32 is about equal to, or slightly less than, the width of an opening 20, i.e., the distance between two vertical wires 19. Along its upper edge, base 32 is formed with an upwardly opening groove 33, and along its lower edge, the base is formed with a downwardly opening groove 34. The width of each groove is equal to, or slightly larger than, the diameter of one of the horizontal grid wires 18. The depth of groove 33 exceeds the depth of groove 34. Between grooves 33 and 34, the thickness of base 32 is reduced, to save material, but a strengthening rib 35 remains extending between the grooves.

A projection 38 extends forwardly from base 32. In the FIGS. 2–6 embodiment, projection 38 is a straight, upwardly tilted finger. Other examples of projections are the ring-like formation 39 of FIG. 7, the hook formation 40 of FIG. 8, and the L-shaped formation 41 of FIG. 9. In each of FIGS. 7–9, base 32' may be identical to base 32 of FIGS. 2–6.

Referring again to FIGS. 3–6, a protuberance 42 projects from one side of groove 34 toward the other side, to partially reduce the size of the opening. The smallest distance between protuberance 42 and the side of groove 34 opposite the side from which protuberance 42 projects is a little smaller than the diameter of a grid wire 18.

Figure 3:
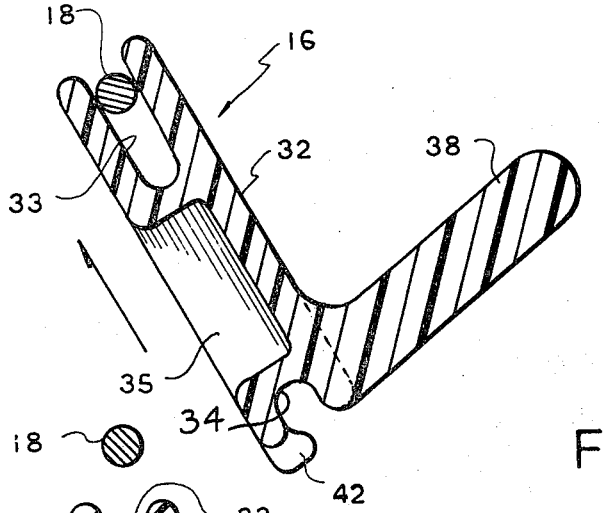
FIGS. 3–5 are a sequence of cross-sectional views showing how and article support element is mounted on the grid, FIG. 5 being a cross-sectional view taken along line 5—5 of FIG. 2.
Figure 4:
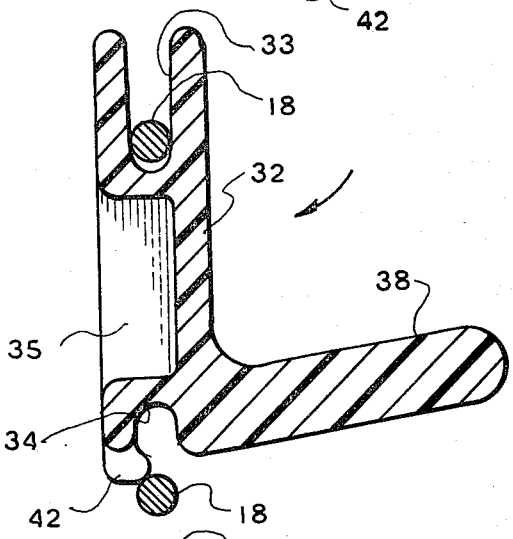
Figure 5:
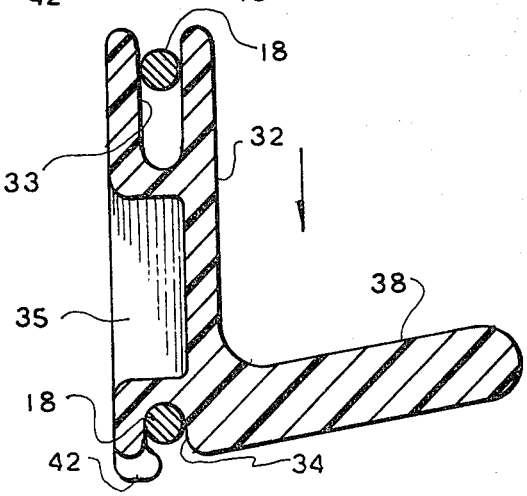

Article support element 16 is mounted in any selected hole 20 of grid 15 in the manner indicated in FIGS. 3–5. First, element 16 is held so that base 32 is at an angle to the plane of the grid, and upper groove 33 is slipped over the wire 18 which defines the upper edge of the selected opening 20. Movement in the direction of the arrow in FIG. 3 is continued until wire 18 reaches the bottom of groove 33. The article support element is then rotated about the wire 18 within groove 33, in the direction of the arrow in FIG. 4, until lower groove 34 is directly over the wire 18 defining the lower edge of the selected opening 20. Element 16 is then moved downwardly, in the direction of the arrow in FIG. 5 to insert lower wire 18 into groove 34. The inherent resilience of the material of which element 16 is made permits protuberance 42 to yield and wire 18 to move between protuberance 42 and the far side of groove 34. Also, the distance between the bottom of groove 33 and the lower edge of protuberance 42 is less than the height of an opening 20, i.e., less than the distance between successive wires 18, so as to permit protuberance 42 to move past the lower wire 18 to the position shown in FIG. 4.

With the article support element 16 mounted within an opening 20, as shown in FIGS. 2 and 5, the element cannot be pulled directly out of the plane of the grid since two opposite edges of the opening, in the form of wires 18, are held within grooves 33 and 34 of the element. Furthermore, the article support element cannot be rotated with respect to the grid, since its base 32 substantially fills the selected opening 20. In addition, element 16 will not be accidently lifted, so as to cause disengagement of groove 34 and its respective wire 18, due to the locking function played by protuberance 42, i.e., a positive upward force must be applied to element 16 to force wire 18 outwardly past protuberance 42. This is, of course, possible when it is desired to move a particular article support element from one opening 20 to another. Thus, it will be appreciated that while an element 16 can readily be mounted in any selected opening 20 in the grid, it is very firmly held in that opening and will not accidently be dislodged.

A wide variety of articles may be supported on elements 16 once they are mounted on grid 15, which in turn has been mounted on a wall. FIG. 6 shows, in dot-dash lines, a spool of thread 45 slipped over projection 38. In fact, rows of elements 16 mounted on a grid serve as an ideal device for storing a large quantity of spools of thread in a readily accessible way. Each of FIGS. 7–9 indicate other items which may be stored on an article support element according to this invention.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

I claim:

1. An article support arrangement comprising:

(a) a grid adapted to be mounted on a wall, the grid having a plurality of non-circular openings, (b) a plurality of article support elements adapted to be mounted on the grid, each element having a non-circular base and a projection extending from the base for engaging an article to be supported, the base fitting into any selected one of the plurality of openings in the grid, (c) the base having means for holding opposite edges of a grid opening so as to prevent the article support element, once accommodated within a grid opening, from being pulled directly out of the plane of the grid, the preventing means including two grooves in the base of the article support element, the grooves opening in opposite directions and being capable of accommodating two opposite edges of a grid opening, and (d) a protuberance projecting into one of the two grooves from one side of the groove to at least partially reduce the size of the opening into that groove.

2. An article support arrangement as defined in claim 1 wherein the preventing means also prevent rotation of the article support element with respect to the grid once the article support element is accommodated within a grid opening.

3. An article support arrangement as defined in claim 1 wherein the openings in the grid are rectangular.

4. An article support arrangement as defined in claim 1 wherein the openings in the grid are square.

5. An article support arrangement as defined in claim 1 wherein the grid is fabricated of mutually perpendicular wires fastened together at their points of intersection.

6. An article support arrangement as defined in claim 4 wherein the wires are metal.

7. An article support arrangement as defined in claim 1 wherein the shape of the base of each article support element corresponds generally to the shape of the openings in the grid.

8. An article support arrangement as defined in claim 1 wherein the preventing means include two grooves in the base of the article support element, the grooves opening in opposite directions and being capable of accommodating two opposite edges of a grid opening.

9. An article support arrangement as defined in claim 1 wherein one of the grooves is deeper than the other, and the distance between the bottoms of the two grooves is less than the distance between two opposite edges of a grid opening.

10. An article support arrangement as defined in claim 9 wherein said protuberance projects into the shallower of the two grooves from one side of the groove to at least partially reduce the size of the opening into that groove.

11. An article support arrangement as defined in claim 10 wherein the grid is fabricated of mutually perpendicular wires fastened together at their points of intersection, and the spacing between the protuberance and the other side of the groove into which it projects is smaller than the diameter of the wire of which the grid is fabricated.

12. An article support arrangement as defined in claim 1 including a bracket for mounting the grid on a wall, the bracket including a portion extending upwardly and spaced from the wall when the bracket is mounted on a wall, the portion fitting through an opening in the grid.

* * * * *